United States Patent [19]

Happel

[11] Patent Number: 4,738,644

[45] Date of Patent: Apr. 19, 1988

[54] OUTBOARD MOTOR ATTACHMENT AND METHOD

[76] Inventor: Thomas Happel, 180 S. Banana River Dr., Merritt Island, Fla. 32952

[21] Appl. No.: 19,937

[22] Filed: Feb. 27, 1987

[51] Int. Cl.[4] ..... B63H 21/26

[52] U.S. Cl. ..... 440/900; 440/76; 440/66; 204/196

[58] Field of Search ..... 440/49, 66, 76, 78, 440/89, 113, 900; 204/147, 148, 196, 197

[56] References Cited

U.S. PATENT DOCUMENTS

| | | | |
|---|---|---|---|
| 1,226,400 | 5/1917 | Smith | 440/66 X |
| 2,860,594 | 11/1958 | Kiekhaefer | 440/66 |
| 2,896,565 | 7/1959 | Stevens | 440/66 |
| 3,179,582 | 4/1965 | Preiser | 204/148 X |
| 3,209,716 | 10/1965 | Hartley | 440/900 X |
| 3,240,180 | 3/1966 | Byrd | 204/196 X |
| 3,276,779 | 4/1973 | Morgan | 204/197 |
| 3,768,432 | 10/1973 | Spaulding | 440/66 |
| 3,799,103 | 3/1974 | Granholm | 440/66 |
| 3,980,035 | 9/1976 | Johansson | 440/66 |
| 4,031,846 | 6/1977 | Tone | 440/66 |
| 4,070,983 | 1/1978 | Randall | 440/66 |
| 4,205,618 | 6/1980 | Olsson | 440/66 |
| 4,323,355 | 4/1982 | Kondo | 440/76 |
| 4,486,181 | 12/1984 | Cavil | 440/900 X |
| 4,487,152 | 12/1984 | Larson | 440/66 X |
| 4,529,387 | 7/1985 | Brandt | 440/66 |
| 4,549,949 | 10/1985 | Guinn | 440/78 X |
| 4,559,017 | 12/1985 | Cavil et al. | 440/113 X |
| 4,604,068 | 8/1986 | Guinn | 440/900 X |
| 4,615,684 | 10/1986 | Kojima | 440/88 |

*Primary Examiner*—Galen Barefoot
*Assistant Examiner*—Paul E. Salmon
*Attorney, Agent, or Firm*—William M. Hobby, III

[57] ABSTRACT

An outboard motor drive shaft housing attachment apparatus includes at least one extended fin plate, having a raised front portion and a pair of angled side portion and an attachment bar shaped to fit an opening in the outboard motor shaft housing. The attachment bar is passed through the opening in the shaft housing and removably attached to the fin plate with fasteners. Additional fasteners are used to attach the fin plate to the outboard motor shaft housing. The fin plate can have anti-skid steps formed thereon and a sacrificial anode attached thereto. A method of attaching an outboard motor attachment, comprises the steps of removing the outboard drive shaft housing sacrificial anode to leave an opening through the housing; sliding a shaft through the opening in the housing created by the removal of the sacrificial anode; attaching a fin plate to the shaft extending through the shaft housing opening; and then attaching the fin plate directly to the housing with threaded fasteners. Additional steps may include selecting a fin plate with non-skid surface steps thereon and attaching a sacrificial anode thereto to replace the sacrificial anode removed from the shaft housing.

12 Claims, 1 Drawing Sheet

10
11
13
36
35
37
15
12
14

32

14
23
27
28
25
31
24
26
30
38
18
20
21
32
23
27
34
17
26
28
13
31
25
24
16
30
3

3
38
14

OUTBOARD MOTOR ATTACHMENT AND METHOD

BACKGROUND OF THE INVENTION

The present invention relates to outboard motor drive shaft housing attachments and to methods of attaching an outboard motor drive shaft housing attachment, for increasing the performance of the outboard motor.

Outboard motors and inboard-outboard motors commonly have an internal combustion engine having an attachment bracket having a transom clamp and clamp screw formed thereon. The transom clamp supports the engine to the boat transom with a drive shaft extending from the engine along the transom of the boat into the water. The drive shaft typically has a drive shaft housing covering most of the drive shaft and a propeller is attached to the end of the drive shaft. Outboard engines typically have an anti-cavitation plate formed thereon and may have an exhaust port for exhausting gasses from the engine. Cooling liquid can be drawn from the water up the drive shaft housing to the engine and back into the water with the exhaust. Various types of attachments have been suggested in the past for accomplishing different purposes in the operation of the engine on a boat.

In U.S. Pat. No. 2,860,594 to Kiekhaefer, a splash deflector is attached to the housing to act as a splash guard to prevent the splashing of water into the back of the boat. In U.S. Pat. No. 3,980,035 to Johansson, an attitude control device for stern drive power boats, is utilized on a stern drive boat protruding down into the water. In contrast, the present invention attaches a fin plate above the water level. In U.S. Pat. No. 4,031,846 to Tone, an anticavitation shroud and rudder is attached to an inboard direct shaft boat under the water, while in U.S. Pat. No. 4,205,618 to Olsson, a trimming and stabilizing system for an outboard motor shaft housing is used to hold the boat in a planing position by extending into the water and controls the lifting of the stern. In U.S. Pat. No. 2,896,565 to Stevens, a hydraulic flow control plate is attached to the back of inboard boats to control the lifting of the stern. In U.S. Pat. No. 3,799,103 to Granholm, a stern drive unit trim tab is attached to an outboard motor drive shaft housing in a partially submerged position during normal operation. The U.S. Pat. No. 3,768,432 to Spaulding, provides a shallow water adapter for outboard motors, and provides a mounting to partially surround a propeller of an outboard motor which is attached to the outboard motor shaft housing. This unit is under water at all times to allow the propeller to pass through shallow water.

In contrast to these prior devices, the present invention has fin plates mounted above the water level for forcing air and water exiting from the bottom of the boat back towards the propeller to compress the air and water for removing the air and forcing the water into the propeller to thereby provide increased performance with the propeller, especially during rapid acceleration and high speed maneuvers.

SUMMARY OF THE INVENTION

An outboard motor drive shaft housing attachment is attached to an outboard motor, having a drive shaft and drive shaft housing and a propeller attached to the drive shaft and with the drive shaft housing having a removable member removable to create an opening through the drive shaft housing. The attachment for the drive shaft housing includes at least one extended fin plate having a raised front portion and a pair of angled side portions. An attachment bar is shaped to fit through the opening in the outboard motor shaft housing where the sacrificial anode has been removed. Removable fasteners attach the bar to the fin plate to support the fin plate to the housing through the bar, and threaded fasteners are used to attach the fin plate directly to the housing. The fin plate may have antiskid steps formed thereon for use in entering and exiting the boat and may include a stiffening bracket bolted between the housing and the fin plate. The fin plate may also have a sacrificial anode formed therein or attached thereto to replace the anode removed from the housing to create the opening for the attachment bar.

A method of attaching an outboard motor attachment to the outboard motor drive shaft housing includes the steps of removing the outboard drive shaft housing sacrificial anode to leave an opening through the housing; sliding a shaft such as a square shaft through the opening in the housing; attaching a fin plate to the shaft extending through the opening in the shaft housing, then attaching a fin plate directly to the housing with removable fasteners, and attaching a strengthening brace between the housing and the fin plate. Additional steps may include selecting a fin plate having anti-skid steps formed thereon for entering and exiting the boat and selecting a fin plate having a sacrificial anode formed therein for attaching a sacrificial anode thereto to replace the removed sacrificial anode.

BRIEF DESCRIPTION OF THE DRAWINGS

Other objects, features and advantages of the present invention will be apparent from the written description and the drawings in which.

DESCRIPTION OF THE PREFERRED EMBODIMENTS

Figures 1, 2, 3, 4:
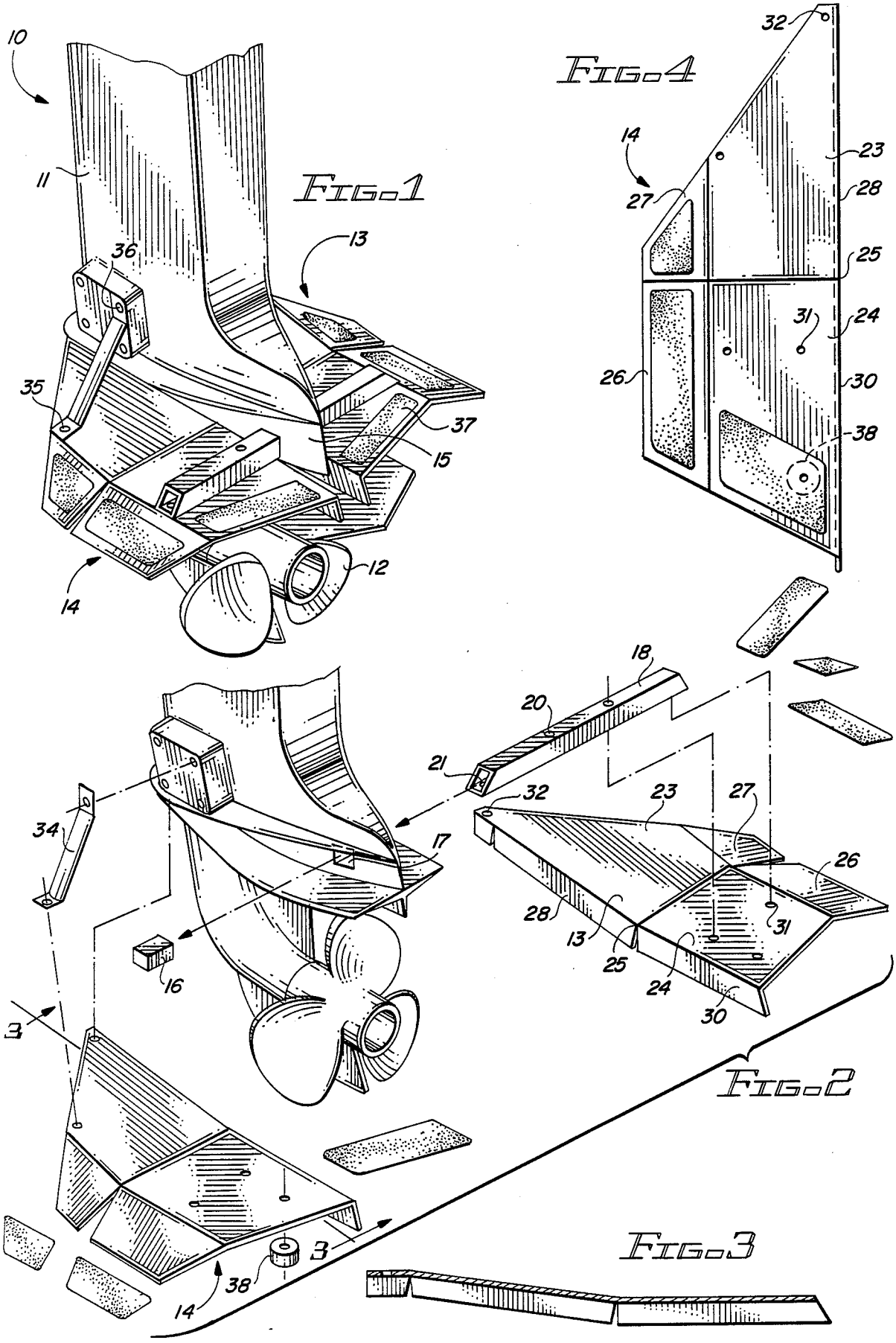
FIG. 1 is a perspective view of a portion of an outboard motor drive shaft housing having an attachment in accordance with the present invention.
FIG. 2 is an exploded perspective of the attachment drive shaft housing of FIG. 1.
FIG. 3 is a sectional view taken on line 3—3 of FIG. 2.
FIG. 4 is a top plan view of one fin plate as used in FIGS. 1 thru 3.

Referring to FIGS. 1 through 4 of the drawings, an outboard motor propeller shaft housing 10 includes the housing 11 and an outboard motor propeller 12 which is attached to the drive shaft of the outboard motor. A pair of fin plates 13 and 14 are attached to the housing 11 adjacent to anti-cavitation plate and exhaust outlet 15. The housing 11 has a sacrificial anode 16 which may be a block of zinc in an opening 17 for reducing corrosion in the motor drive shaft housing and propeller. A fin plate support shaft 18 is used for attaching the fin plates 13 and 14 and may be a square shaft of the shape and size of the opening 17. There would typically be a hollow metal shaft 18 having a plurality of openings 20 therethrough, as well as a plurality opening 21 passing through one side of the shaft 18. The fin plates 13 and 14 each have an upwardly extending front portion 23, flat portion 24, separated by a crease 25, and an angled side 26 adjacent the flat portion 24 and angled side 27 adjacent the raised portion 23. A side angled plate 28 on each fin plate raised portion 23 and a side angled plate 30 on the flat portion 24, are on opposite sides from the angled sides 26 and 27. A plurality of openings 31 allow threaded fasteners, such as screws or bolts, to pass therethrough and through the openings 20 of the shaft 18 or openings 21 of the shaft 18, while an aperture 32 allows threaded fastener, to be bolted directly into the drive shaft housing 11. In this case, the fin plates 13 and 14 are attached to opposite sides of the housing 11, but it should be clear that one fin plate could be adapted to fit around the housing and attached thereto with the shaft 18. A stiffening brace 34 is anchored with bolts 35 to each fin plate 13 and 14 and each brace 34 is attached with the existing fastener 36 to the housing 11. The use of the shaft 18, the support brace 34 and the additional threaded fasteners provides for relatively thin steel or aluminum fin plates 13 and 14 which have the strength to also act as steps for entering the boat. A plurality of anti-skid surfaces 37 may be applied directly to the top of the fin plate such as with clean sand intermixed with an elastomer paint or other coating, or may be separate anti-skid pads attached to the surface of each fin plate 13 or 14. A sacrificial anode 38 may be attached with a bolt through an opening in the fin plate 14 to replace the anode 16 removed from the outboard motor housing in order to attach the fin plates. The sacrificial anode 38 would typically be a block of zinc having rounded edges so as not to interfere with the operation of the fin plates.

The fin plates as shown in FIG. 1, as attached with the shaft 18, are attached above the water level of the boat and in operation, capture intermixed air and water passing under the boat and compress the intermixed air and water down towards the propeller to thereby prevent loss of power and free spinning of the propeller by virtue of too much air passing thereby, so that the screw action of the propeller is maintained during fast accelerations and during high speeds. The plate also acts as a step for entering and exiting the boat from the rear, adjacent the transom, as well as replacing the sacrificial anode.

A method of attaching an outboard motor attachment, includes the steps of removing the outboard drive shaft housing sacrificial anode 16 to leave an opening 17 in the housing. The opening 17 is generally of square cross section. The next step is sliding a shaft 18 through the opening 17 created by the removal of the sacrificial anode 16 and centering the shaft 18 in the housing opening 17 and attaching the fin plates 13 and 14 to the shaft 18. The method also includes attaching fin plates 13 and 14 through the openings 32 directly into the housing 11, whereby a pair of fin plates are attached to the outboard motor shaft housing with great strength. The method also includes the step of attaching a replacement sacrificial anode to one of the fin plates and selecting fin plates having a raised front and angled sides and anti-skid surfaces attached thereto. The process may also include the attaching of a strengthening bracket arm with threaded fasteners between the housing and the fin plates.

It should be clear at this point that an attachment for an outboard engine drive shaft housing has been provided which is located above the water on the shaft housing, just above the anit-cavitation plate of the outboard engine, and that a method for attaching the attachment to an outboard engine shaft housing has been described. However, the present invention is not to be considered as limited to the forms shown which are to be considered illustrative rather than restrictive.

I claim:

1. An outboard engine drive shaft housing attachment comprising:

an outboard engine drive shaft housing having a removable sacrificial anode thereon, which creates an opening through the drive shaft housing when removed;

an attachment for said outboard engine drive shaft housing including at least one extended fin plate having a raised front portion and a pair of angled side portions;

an attachment bar shaped to fit said opening in the outboard engine shaft housing created by the removal of the sacrificial anode;

means to removably attach said attachment bar to the at least one fin plate to support the fin plate to the drive shaft housing; and fastening means for attaching said at least one fin plate to the drive shaft housing, whereby said outboard engine drive shaft housing attachment is attached with great rigidity.

2. An outboard engine drive shaft housing attachment in accordance with claim 1 in which said at least one fin plate has anti-skid surfaces formed thereon.

3. An outboard engine drive shaft housing attachment in accordance with claim 2 in which said attachment bar is a hollow shaft having a square cross section.

4. An outboard engine drive shaft housing attachment in accordance with claim 3 in which said at least one fin plate has a sacrificial anode attached thereto.

5. An outboard engine drive shaft housing attachment in accordance with claim 4 including a support bracket attached between said outboard engine drive shaft housing and said fin plate.

6. An outboard engine drive shaft housing attachment in accordance with claim 5 having a pair of fin plates, one attached to either side of said drive shaft housing.

7. An outboard engine drive shaft housing attachment in accordance with claim 6 in which said means to removably attach said attachment bar to said fin plates includes a plurality of threaded bolts.

8. A method of attaching an outboard engine drive shaft attachment to the engine drive shaft housing of the type having a sacrificial anode attached to the housing comprising the steps of:

removing the outboard drive shaft housing sacrificial anode to leave an opening through said drive shaft housing;

sliding a shaft through said opening in said drive shaft housing;

attaching a fin plate to said shaft extending through said opening in said drive shaft housing; and attaching said fin plate to said drive shaft housing, whereby said fin plate is rigidly attached to said outboard engine drive shaft housing.

9. A method in accordance with claim 8 including the step of attaching a sacrificial anode to said fin plate.

10. A method in accordance with claim 9 including the step of selecting a fin plate having anti-skid surfaces thereon.

11. A method in accordance with claim 10 including the step of attaching a strengthening brace between said outboard engine drive shaft housing and said fin plate.

12. A method in accordance with claim 8 including attaching a pair of fin plates to said shaft extending through said opening in said outboard engine drive shaft housing.

* * * * *